US006211308B1

(12) United States Patent
Saint Victor

(10) Patent No.: US 6,211,308 B1
(45) Date of Patent: Apr. 3, 2001

(54) METHOD FOR COATING A TEXTILE

(75) Inventor: Marie-Esther Saint Victor, Blue Bell, PA (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/137,001

(22) Filed: Aug. 20, 1998

(51) Int. Cl.[7] ..... C08F 283/00; C08F 2/48; D06Q 1/12; D06M 10/04

(52) U.S. Cl. ..... 525/531; 525/530; 525/532; 8/115.52; 8/115.53; 8/115.62; 8/636; 8/DIG. 12; 442/154; 442/156; 442/168; 442/170; 442/164; 526/75; 526/321; 522/78; 522/103; 427/513

(58) Field of Search ..... 8/115.52, 115.53, 8/115.62, 636, DIG. 12; 525/530, 531, 532; 526/75, 321; 522/78, 103; 427/513; 442/154, 156, 168, 170, 164

(56) References Cited

U.S. PATENT DOCUMENTS

| | | | |
|---|---|---|---|
| 4,216,287 | 8/1980 | Sano et al. | 430/271 |
| 4,271,258 | 6/1981 | Watariguchi | 430/284 |
| 4,362,808 | 12/1982 | Otthofer, Jr. | 430/308 |
| 4,391,898 | 7/1983 | van der Velden | 430/306 |
| 4,404,075 | 9/1983 | Ikeda et al. | 204/159.23 |
| 4,764,395 | 8/1988 | Felder et al. . | |
| 5,278,009 | 1/1994 | Iida et al. | 430/7 |
| 5,340,681 | 8/1994 | Sypek et al. | 430/138 |
| 5,514,727 | 5/1996 | Green et al. | 522/15 |
| 5,549,929 | 8/1996 | Sheibelhoffer et al. . | |
| 5,637,380 | 6/1997 | Kaneko et al. | 428/204 |
| 5,688,633 | 11/1997 | Leach | 430/284.1 |
| 5,889,076 * | 3/1999 | Dones et al. | 522/143 |
| 5,972,809 | 10/1999 | Faler et al. . | |

OTHER PUBLICATIONS

*Radiation Curing of Polymeric Materials*, ACS Symposium Series 417, Charles E. Hoyle, Editor and James F. Kinstle, Editor, American Chemical Society, Washington, DC, 1990, pp. 1–16.

*Printing–Ink Vehicles*, Encyclopedia of Polymer Science and Engineering, vol. 13, pp. 368–398 (1988).

*Photopolymerization of Surface Coatings*, C.G. Roffey, John Wiley & Sons, pp. 209–243.

* cited by examiner

*Primary Examiner*—Margaret G. Moore
(74) *Attorney, Agent, or Firm*—John E. Drach; Adrian T. Calderone; Peter G. Dilworth

(57) ABSTRACT

A method for coating a textile includes applying a substantially water-free, energy-curable, polymer-forming composition to the textile and exposing the textile and composition to a source of energy under such conditions as to generate chemically active sites on the surface of the textile and polymerize the composition. The resulting polymer is grafted onto the textile. Preferably, the energy is derived from electron beam radiation. The composition includes an epoxy oligomer having at least two ethylenically unsaturated moieties, and at least one alkoxylated polyol monomer having at least two ethylenically unsaturated moieties and capable of being copolymerized with the epoxy oligomer. Preferably, the composition also includes a surface active agent capable of rendering the uncured composition dispersible in water. Optionally, the composition can contain a colorant, and photoinitiator. The composition is especially suitable for use as a screen printing ink and coating material for textiles.

63 Claims, No Drawings

METHOD FOR COATING A TEXTILE

BACKGROUND OF THE INVENTION

1. Field of the Invention

The present invention relates to a method for coating or printing on a textile by applying thereto a water-free, energy-curable, polymer-forming composition, especially useful as or in a coating or ink, the composition containing an epoxy oligomer, and an alkoxylated polyol monomer.

2. Background of the Art

Printing inks generally are composed of coloring matter such as pigment or dye dispersed or dissolved in a vehicle. The ink can be a fluid or paste that can be printed onto a substrate such as paper, plastic, metal, or ceramic and then dried.

Inks can be classified according to the substrate onto which the ink is intended to be applied or the method of application. For example, inks can be applied by raised type (e.g. letter press, flexographic), from a planar surface (lithographic), from a recessed surface (intaglio) or through a stencil (silk screen). Different methods of application and different substrates require different properties in the ink.

In silk screen printing, the ink is forced onto a substrate through a stencil, or "mask", having a porous screen area configured in the shape of the indicia to be printed such as letters or graphics. The substrate can be paper, textile, metal, ceramic, polymer film, and the like. The screen can be a gauze or mesh fabricated from metal, silk, or various polymer materials.

The mask is generally prepared by coating a screen with a curable composition, curing the composition, and then engraving indicia on the screen. The engraved areas are porous, thereby permitting ink to be forced through the screen onto the substrate to print the indicia.

After printing, the ink on the substrate is cured or hardened by any of several methods such as, for example, exposure of the ink to heat or radiation (e.g. ultraviolet, electron beam, and the like), evaporation of a solvent in the ink composition, or oxidation hardening of drying oil components (e.g linseed oil, tung oil), and the like.

Apart from printing, coatings can also be applied to substrates for purposes of surface modification. For example, coatings can be applied to textiles to improve color fastness, water repellency, or other properties.

The three main technologies being practiced today which make up the bulk of the coatings and inks include solvent borne, water borne, and zero volatile organic compounds (VOC). Solvent borne and water borne systems produce inks and coatings which, in their uncured state, are washable. Water washability is a desired feature of the coating composition since the coating application equipment needs to be cleaned for reuse. However, there has been a technological push to eliminate organic solvents and water as components in the ink or coating composition. Organic solvents present environmental health concerns. And both solvent based and water based systems are energy intensive, requiring drying ovens to remove the solvent or water. For example, thermally induced drying and curing of coated screen fabric typically requires about 7,000 to 12,000 kilojoules of energy per kilogram of fabric as well as a long curing time, typically several hours.

The use of textiles as a substrate for printing and coating presents additional problems. For the past two decades considerable efforts have been made to develop energy polymerizable screen printing inks for fabrics. One desired property of an ink or coating applied to textiles is that the ink or coating adheres firmly to the textile. For example, a poorly adherent ink will not have the requisite color fastness or abrasion resistance and may degrade under normal wearing and washing conditions. A high degree of crosslinking enhances abrasion resistance and color fastness, and facilitates the grafting of the ink onto the fabric. However, another desired property is that the ink or coating be flexible. With a stiff ink or coating the textile loses the tactile properties, or "feel," of the original fabric. Low crosslinking produces soft, flexible films. Consequently, what is desired is a method for printing or coating a textile with a waterless, zero VOC composition wherein the treated textile retains its original feel while exhibiting good color fastness and durability of the ink or coating.

SUMMARY OF THE INVENTION

In accordance with the present invention, a method for coating a textile is provided herein which comprises:

a) providing a substantially water-free, energy-curable, polymer-forming composition containing
   i. an acrylate oligomer having at least two ethylenically unsaturated moieties, and
   ii. at least one alkoxylated polyol monomer having at least two ethylenically unsaturated moieties and capable of being copolymerized with epoxy oligomer (a) to provide a solid cured polymer when exposed to energy-polymerizing conditions, and said solid cured polymer being capable of chemically bonding to active sites on the textile;

b) applying said polymer-forming composition to the textile; and c) exposing the textile to a source of energy under such conditions as to generate chemically active sites on the textile, curing the polymer-forming composition to provide a polymer, and forming chemical bonds between the textile and the cured polymer.

The method advantageously produces a soft, adherent coating on the textile such that the textile retains its feel as well as color fastness. Moreover, the composition contains no VOCs and is readily dispersible in water.

DETAILED DESCRIPTION OF THE PREFERRED EMBODIMENTS

While the present invention is particularly applicable to coatings and inks applied by silk screen methods, it should be understood that any coating application, for printing or non-printing purposes, is within its scope. The term "coating" as used herein shall be understood as including, inter alia, printing indicia onto the textile with an ink, as well as coating the textile overall with a colored or non-colored composition. Percentages of materials are by weight unless stated otherwise. Note that all quantities appearing hereinafter shall be understood to be modified by the term "about" except in the Examples and unless indicated otherwise.

The substantially water-free, energy-curable, polymer-forming composition herein includes an acrylate oligomer having at least two polymerizable ethylenically unsaturated moieties, and an alkoxylated polyol monomer having at least two ethylenically unsaturated moieties. Preferably, a surface active agent which is capable of being integrated into the molecular structure of the polymer resulting from the copolymerization of the acrylate oligomer and the alkoxylated polyol monomer is also included as a component of the composition. As mentioned below, the integration of the surface active agent can be by covalent bonding or hydrogen bonding. The surface active agent renders the composition water-dispersible.

The acrylate oligomer can be selected from epoxy acrylate oligomer, polyester acrylate oligomer, and polyurethane acrylate oligomer. Suitable acrylate oligomers are discussed in greater detail below.

Generally, the energy-polymerizable composition of the present invention includes the following component weight percentages:

| | |
|---|---|
| Oligomers | 30%–70% |
| Monomers | 30%–70% |
| Surfactants | 0 to about 20% |
| Photoinitiators | 0–10% |

The epoxy acrylate oligomer can be prepared by reacting an epoxide with an unsaturated acid such as acrylic or methacrylic acid, optionally in the presence of a polyamide derived from a polymerized fatty acid.

In one embodiment the epoxy acrylate oligomer is derived from a compound having the formula:

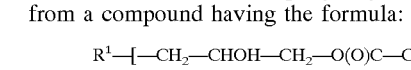

$$R^1—[—CH_2—CHOH—CH_2—O(O)C—CH=CH_2]_n$$

wherein $R^1$ is an aliphatic, aromatic or arene moiety having at least two carbon atoms and at least two oxido residues, and n is an integer of from 2 to 6.

Useful epoxides include the glycidyl ethers of both polyhydric phenols and polyhydric alcohols, epoxidized fatty acids or drying oil acids, epoxidized diolefins, epoxidized di-unsaturated acid esters, as well as epoxidized unsaturated polyesters, preferably containing an average of more than one epoxide group per molecule. The preferred epoxy compounds will have a molecular weight of from 300 to 600 and an epoxy equivalent weight of between 150 and 1,200.

Representative examples of the epoxides include condensation products of polyphenols and (methyl) epichlorohydrin. For the polyphenols, there may be listed bisphenol A, 2,2'-bis(4-hydroxyphenyl)methane (bisphenol F), halogenated bisphenol A, resorcinol, hydroquinone, catechol, tetrahydroxyphenylethane, phenol novolac, cresol novolac, bisphenol A novolac and bisphenol F novolac. There may also be listed epoxy compounds of the alcohol ether type obtainable from polyols such as alkylene glycols and polyalkylene glycols, e.g. ethylene glycol, 1,2-propylene glycol, 1,3-propylene glycol, 1,4-butanediol, 1,6-hexanediol, neopentyl glycol, glycerine, diglycerol, trimethylolpropane, pentaerythritol, inositol, sorbitol, polyethylene glycol, polypropylene glycol, polytetrahydrofuran, (i.e., poly(1,4-butanediol), which is obtainable under the designation TERATHONE® from DuPont), and alkylene oxide-adduct of bisphenols, and (methyl)epichlorohydrin; glycidyl amines obtainable from anilines such as diaminodiphenylmethane, diaminophenylsulfone and p-aminophenol, and (methyl)epichlorohydrin; glycidyl esters based on acid anhydrides such as phthalic anhydride and tetrahydro- or hexahydro- phthalic anhydride; and alicyclic epoxides such as 3,4-epoxy-6-methylcyclohexylmethyl and 3,4-epoxy-6-methylcyclohexyl carboxylate.

Glycidyl polyethers of polyhydric phenols are made from the reaction of a polyhydric phenol with epihalohydrin or glycerol dihalohydrin, and a sufficient amount of caustic alkali to combine with the halogen of the halohydrin. Glycidyl ethers of polyhydric alcohols are made by reacting at least about 2 moles of an epihalohydrin with 1 mole of a polyhydric alcohol such as ethylene glycol, pentaerythritol, etc., followed by dehydrohalogenation.

In addition to polyepoxides made from alcohols or phenols and an epihalohydrin, polyepoxides made by the known peracid methods are also suitable. Epoxides of unsaturated esters, polyesters, diolefins and the like can be prepared by reacting the unsaturated compound with a peracid. Preparation of polyepoxides by the peracid method is described in various periodicals and patents and such compounds as butadiene, ethyl linoleate, as well as di- or tri-unsaturated drying oils or drying oil acids, esters and polyesters can all be converted to polyepoxides. Epoxidized drying oils are also well known, these polyepoxides usually being prepared by reaction of a peracid such as peracetic acid or performic acid with the unsaturated drying oil according to U.S. Pat. No. 2,569,502.

In certain embodiments, the diepoxide is an epoxidized triglycerides containing unsaturated fatty acids. The epoxidized triglyceride may be produced by epoxidation of one or more triglycerides of vegetable or animal origin. The only requirement is that a substantial percentage of diepoxide compounds should be present. The starting materials may also contain saturated components. However, epoxides of fatty acid glycerol esters having an iodine value of 50 to 150 and preferably 85 to 115 are normally used. For example, epoxidized triglycerides containing 2% to 10% by weight of epoxide oxygen are suitable. This epoxide oxygen content can be established by using triglycerides with a relatively low iodine value as the starting material and thoroughly epoxidizing them or by using triglycerides with a high iodine value as starting material and only partly reacting them to epoxides. Products such as these can be produced from the following fats and oils (listed according to the ranking of their starting iodine value): beef tallow, palm oil, lard, castor oil, peanut oil, rapeseed oil and, preferably, cottonseed oil, soybean oil, train oil, sunflower oil, linseed oil. Examples of typical epoxidized oils are epoxidized soybean oil with an epoxide value of 5.8 to 6.5, epoxidized sunflower oil with an epoxide value of 5.6 to 6.6, epoxidized linseed oil with an epoxide value of 8.2 to 8.6 and epoxidized train oil with an epoxide value of 6.3 to 6.7.

Further examples of polyepoxides include the diglycidyl ether of diethylene glycol or dipropylene glycol, the diglycidyl ether of polypropylene glycols having molecular weight up to, for example, 2,000, the triglycidyl ether of glycerine, the diglycidyl ether of resorcinol, the diglycidyl ether of 4,4'-isopropylidene diphenol, epoxy novolacs, such as the condensation product of 4,4'-methylenediphenol and epichlorohydrin and the condensation of 4,4'-isopropylidenediphenol and epichlorohydrin, glycidyl ethers of cashew nut oil, epoxidized soybean oil, epoxidized unsaturated polyesters, vinyl cyclohexene dioxide, dicyclopentadiene dioxide, dipentene dioxide, epoxidized polybutadiene and epoxidized aldehyde condensates such as 3,4-epoxycyclohexyl methyl-3',4'-epoxycyclohexane carboxylate.

Particularly preferred epoxides are the glycidyl ethers of bisphenols, a class of compounds which are constituted by a pair of phenolic groups interlinked through an intervening aliphatic bridge. While any of the bisphenols may be used, the compound 2,2-bis (p-hydroxyphenyl) propane, commonly known as bisphenol A, is more widely available in commerce and is preferred. While polyglycidyl ethers can be used, diglycidyl ethers are preferred. Especially preferred are the liquid Bisphenol A-epichlorohydrin condensates with a molecular weight in the range of from 300 to 600.

The acid component is comprised of an ethylenically unsaturated acid. Particularly suitable ethylenically unsaturated monocarboxylic acid are the alpha, beta-unsaturated monobasic acids. Examples of such monocarboxylic acid monomers include acrylic acid, beta-acryloxypropionic acid, methacrylic acid, crotonic acid, and alpha-chloroacrylic acid. Preferred examples are acrylic acid and methacrylic acid. Also suitable acid components are adducts of hydroxyalkyl acrylates or hydroxyalkyl methacrylates and the anhydrides of dicarboxylic acids such as, for example, phthalic anhydride, succinic anhydride, maleic anhydride, glutaric anhydride, octenylsuccinic anhydride, dodecenylsuccinic anhydride, chlorendic anhydride, tetrahydrophthalic anhydride, hexahydrophthalic anhydride and methyltetrahydrophthalic anhydride. Such adducts can be prepared by methods of preparative organic chemistry known in the art. The acid component can also contain other carboxylic acids. In certain embodiments, the acid component will be comprised of a minor amount, e.g. less than 50% of the total acid equivalents, more typically less than 20% of the total acid equivalents, of a fatty acid. The fatty acids are saturated and/or unsaturated aliphatic monocarboxylic acids containing 8 to 24 carbon atoms or saturated or unsaturated hydroxycarboxylic acids containing 8 to 24 carbon atoms. The carboxylic acids and/or hydroxycarboxylic acids may be of natural and/or synthetic origin. Examples of suitable monocarboxylic acids are caprylic acid, 2-ethylhexanoic acid, capric acid, lauric acid, myristic acid, palmitic acid, palargonic acid, palmitoleic acid, stearic acid, isostearic acid, oleic acid, elaidic acid, petroselic acid, linoleic acid, linolenic acid, elaeostearic acid, conjuene fatty acid, ricinoleic acid, arachic acid, gadoleic acid, behenic acid, erucic acid and brassidic acid and the technical mixtures thereof obtained, for example, in the pressure hydrolysis of natural fats and oils, in the oxidation of aldehydes from Roelen's oxo synthesis, or as monomer fraction in the dimerization of unsaturated fatty acids. In a particularly preferred embodiment, the fatty acid is derived from technical mixtures of the fatty acids mentioned which are obtainable in the form of the technical mixtures typically encountered in oleochemistry after the pressure hydrolysis of oils and fats of animal or vegetable origin, such as coconut oil, palm kernel oil, sunflower oil, rape oil, rapeseed oil and coriander oil and beef tallow. However, the fatty acid may also contain a branched fatty acid residue, for example the residue of 2-ethyl hexanoic acid, isopalmitic acid or isostearic acid.

Preferred fatty acids are mixtures obtained from natural sources, e.g. palm oil, palm kernel oil, coconut oil, rapeseed oil (from old high-erucic acid plants or from new low-erucic acid plants, a.k.a. canola oil), sunflower oil (from old low-oleic plants or from new high-oleic plants), castor oil, soybean oil, cottonseed oil, peanut oil, olive oil, olive kernel oil, coriander oil, castor oil, meadowfoam oil, chaulmoogra oil, tea seed oil, linseed oil, beef tallow, lard, fish oil and the like. Naturally occurring fatty acids typically are present as triglycerides of mixtures of fatty acids wherein all fatty acids have an even number of carbon atoms and a major portion by weight of the acids have from 12 to 18 carbon atoms and are saturated or mono-, di-, or tri-unsaturated.

The preferred epoxy resins, i.e., those made from bisphenol A, will have two epoxy groups per molecule. Thus, the product of a reaction with acrylic or methacrylic acid will contain an epoxy (meth)acrylate compound having a main chain of polyepoxide and both terminals of a (meth)acrylate group, respectively. Accordingly, the stoichiometric amount of acrylic acid to form a diacrylate adduct would be two moles of acid for each two epoxy groups. In practice, however, it is preferred to use an amount of acid slightly in excess of the amount necessary to cover both epoxy groups. Therefore, the amount of acrylic acid reacted is typically between 2.001 moles to 2.1 moles, and more typically between 2.01 and 2.05 moles of acid per two epoxy groups.

Alternatively, the reaction of the epoxide and the acid can take place in the presence of a polyamide derived from a polymerized fatty acid. The polyamide preferably has a number average molecular weight of less than 10,000 grams/mole. Low melting polyamide resins melting within the approximate range of 90° C. to 130° C. may be prepared from polymeric fatty acids and aliphatic polyamines. Typical of the polyamines which may be used are ethylene diamine, diethylene triamine, triethylene tetramine, tetraethylene pentamine, 1,4-diaminobutane, 1,3-diaminobutane, hexamethylene diamine, piperazine, isophorone diamine, 3-(N-isopropylamine)-propylamine, 3,3 '-iminobispropylamine, and the like. A preferred group of these low melting polyamides are derived from polymeric fatty acids, and ethylene diamine and are solid at room temperature.

Suitable such polyamides are commercially available under the trade designation of VERSAMID polyamide resins, e.g. VERSAMID 335, 750 and 744, and are amber-colored resins having a number average molecular weight up to 10,000, preferably from 1,000 to 4,000 and a softening point from below room temperature to 190° C.

The preferred polyamide is VERSAMID 335 polyamide which is commercially available from Henkel Corporation and has an amine value of 3, a number average molecular weight of 1699, as determined by gel permeation chromatography (GPC) using a polystyrene standard, and a polydispersity of 1.90.

The preparation of such VERSAMID polyamide resins is well known and by varying the acid and/or functionality of the polyamine, a great variety of viscosities, molecular weights and levels of active amino groups spaced along the resin molecule can be obtained. Typically, the VERSAMID polyamide resins useful herein have amine values from 0 to 25, preferably 0 to 10, more preferably 0 to 5; viscosities of from about 1 to 30 poises (at 160° C.) and polydispersities of less than 5. The amine value and number average molecular weight of the polyamide can be determined as described in U.S. Pat. No. 4,652,492 (Seiner et. al.), the disclosure of which is incorporated herein by reference.

The polyamide is incorporated into the composition in an amount not exceeding 50% by weight based on the combined weight of the epoxide and acid components and the polyamide. Preferably, an amount not exceeding 25% by weight is utilized and most preferred is an amount of from 5% to 15% by weight.

The reaction between the epoxide and acid can be performed over a wide range of temperatures, e.g. from 40° C. to 150° C., more typically from 50° C. to 130° C. and preferably between 90° C. and 110° C., at atmospheric, sub-atmospheric or superatmospheric pressure; preferably in an inert atmosphere. Esterification is continued until an acid number of 2 to 15 is obtained. This reaction ordinarily takes place in 8 to 15 hours. To prevent premature or undesirable polymerization of the product or the reactants, it is advantageous to add a vinyl inhibitor to the reaction mixture. Suitable vinyl polymerization inhibitors include tert-butylcatechol, hydroquinone, 2,5-ditertiarybutylhydroquinone, hydroquinonemonoethyl ether, etc. Advantageously, the inhibitor is included in the reaction mixture at a concentration of 0.005 to 0.1% by weight based on the total of the reagents.

The reaction between the epoxide and the acid proceeds slowly when uncatalyzed, and can be accelerated by suitable catalysts which preferably are used, such as, for example, the tertiary bases such as triethyl amine, tributylamine, pyridine, dimethylaniline, tris (dimethylaminomethyl)-phenol, triphenyl phosphine, tributyl phosphine, tributylstilbine; alcoholates such as sodium methylate, sodium butylate, sodium methoxyglycolate, etc.; quaternary compounds such as tetramethylammonium bromide, tetramethylammonium chloride, benzyl-trimethylammonium chloride, and the like. At least 0.01 percent, based on total weight of reagents, preferably at least 0.1 percent, of such catalyst is desirable.

Typical examples of suitable monomers which can be used and added to the reaction mixture before or during the reaction, or added after the reaction, as a reactive diluent, are the vinyl or vinylidene monomers containing ethylenic unsaturation, and which can copolymerized with the compositions of this invention are, styrene, vinyl toluene, tertiary butyl styrene, alpha-methyl-styrene, monochlorostyrene, dichlorostyrene, divinylbenzene, ethyl vinyl benzene, diisopropenyl benzene, methyl acrylate, ethyl acrylate, methyl methacrylate, ethyl methacrylate, acrylonitrile, methacrylonitrile, the vinyl esters, such as vinyl acetate and the monovinyl esters of saturated and unsaturated aliphatic, monobasic and polybasic acids, such as the vinyl esters of the following acids: propionic, isobutyric, caproic, oleic, stearic, acrylic, methacrylic, crotonic, succinic, maleic, fumaric, itaconic hexahydrobenzoic, citric, tartaric, etc., as well as the corresponding allyl, methallyl, etc., esters of the aforementioned acids, the itaconic acid monoesters and diesters, such as the methyl, ethyl, butyl esters, etc.; the maleic and fumaric acid monoesters, diesters and their amide and nitrile compounds, such as diethyl maleate, maleyl tetramethyl diamide, fumaryl dinitrile, dimethyl fumarate; cyanuric acid derivatives having at least one copolymerizable unsaturated group attached directly or indirectly to the triazine ring such as diallyl ethyl cyanurate, triallyl cyanurate, etc., ethers such as vinyl allyl ether, divinyl ether, diallyl ether, resorcinol divinyl ether, etc., diallyl chlorendate, diallyl tetrachloro phthalate, diallyl tetrabromophthalate, dibromopropargyl acrylate, as well as the partial fusible or soluble polymerizable polymers of the hereinabove listed monomers, etc.

In preparing the polymerizable compositions containing the reaction product of this invention and one or more of the monomers of the type listed hereinabove, the relative amount of the monomers can vary broadly. In general, however, the monomer or monomers are used at less than 50% by weight of the composition, typically in the range of about 1 % to 30% by weight, and more typically in the range of 5% to 15% by weight.

Epoxy oligomers prepared by reacting an epoxide with acrylic acid in the presence of a polyamide derived from a polymerized fatty acid possess the advantage of being thixotropic. The viscosity of compositions containing such oligomers decreases with the application of increasing agitation or shear stress and gradually returns to its former viscous state when allowed to rest. Thus, the composition exhibits lower viscosity when in the process of being applied to a substrate under the application of force or pressure. However, once the coating has been applied it resumes its high viscosity state and tends to remain on the substrate without running. Thixotropic inks are easier to apply yet produce sharp images.

Examples of suitable polyester acrylate oligomers include those derived from glyceryl propoxylate triacrylate reacted with adipic acid and acrylic acid, and trimethylol propane ethoxylate reacted with dimer acid and acrylic acid. Especially preferred are trimethylol propane dimerester tetraacrylate oligomer and dipolyoxypropylene glycerol adipate oligomer.

Examples of suitable urethane acrylate oligomers include difunctional or trifunctional, aromatic or aliphatic urethane acrylate oligomers. A preferred urethane oligomer is PHOTOMER® 6008 available from Henkel Corporation.

Referring now to the alkoxylated polyol component of the composition described herein, the preferred alkoxylated polyol monomer has the formula.

$$R^2—[—(Y)_x—R^3—CH{=}CH—R^4]_m$$

wherein $R^2$ is an aliphatic, aromatic or arene moiety having at least two carbon atoms and at least two oxido residues, Y is an alkylene oxide moiety and x is an integer of from 2 to 6, $R^3$ is a linkage group capable of joining the alkylene oxide moiety Y and the —CH═CH— group, $R^4$ is hydrogen or —C(O)$OR^5$ wherein $R^5$ is hydrogen or an alkyl group of from 1 to 22 carbon atoms, and m is an integer of from 2 to 6.

More particularly, $R^2$ can be an ethylene glycol residue, propylene glycol residue, trimethylol propane residue, pentaerythritol residue, neopentyl glycol residue, glyceryl residue, diglyceryl residue, inositol residue, sorbitol residue, hydroquinone residue, catechol residue, or bisphenol residue (e.g bisphenol A). $R^2$ can also be selected from saturated or unsaturated straight or branched chain aliphatic moieties of from 6 to 24 carbon atoms such as epoxidized soy bean oil residue. Alternatively, $R^2$ can be polyethylene glycol, or ethylene oxide/propylene oxide copolymer.

Y is preferably an ethylene oxide or propylene oxide residue.

$R^3$ can optionally be, for example, the linking groups —O—, —O(O)C—, —$OCH_2CH_2$—, or —$OCH_2CHOHCH_2O$(O)C—.

The alkoxylated polyol monomer component preferably comprises a mixture of at least one alkoxylated polyol diacrylate such as, for example, bisphenol A ethoxylate diacrylate, trimethylolpropane ethoxylate diacrylate, and/or neopentyl glycol propoxylate diacrylate, and at least one alkoxylated polyol triacrylate such as, for example, trimethylolpropane ethoxylate triacrylate.

A preferred ink composition includes 10% to 15% by weight of neopentyl glycol propoxylate diacrylate, 5% to 10% bisphenol A ethoxylate diacrylate, and 15% to 20% trimethylolpropane ethoxylate triacrylate based on total composition weight. Preferably, also, the epoxy oligomer component used in conjunction with the alkoxylated polyol monomer component is obtained by reacting a diepoxide such as a diglycidyl ether of a dihydric phenol (e.g. bisphenol A) with an unsaturated acid component (e.g. acrylic acid) in the presence of a polyamide derived from a fatty acid.

As mentioned above, the composition preferably includes a surface active agent component. Energy polymerizable screen printing ink pastes are typically water insoluble, hence the need for a surface active agent to provide water dispersibility so that they can be washed off the application equipment. It is most efficient to include the surface active agent as part of the screen printing ink composition rather than as a component in the wash water. The surface active agents described herein are capable of being integrated into the molecular structure of the cured polymer resulting from the copolymerization of the epoxy oligomer and the alkoxylated polyol monomer components. Integration of the surface active agent into the molecular structure of the cured polymer can be accomplished by e.g., covalent bonding. For example, the surface active agent can include on or more active sites capable of establishing covalent bonds such as, for example, unsaturated sites or reactive groups.

Alternatively, the surface active agent can be integrated into the molecular structure of the cured polymer by hydrogen bonds. In either case the surface active agents possess the advantage of not migrating within the cured ink or coating. Moreover, integration of the surfactant prevents water sensitivity of the cured polymer film which would be caused by the presence of free surfactant.

One type of surface active agent found to be suitable for use in the composition of the present invention includes ethylene oxide/propylene oxide block copolymers. Such copolymers are available from BASF Corporation under the designations PLURONIC™ P105, PLURONIC™ F108, PLURONIC™ F104, and PLURONIC™ L44, for example, and have the following formula:

$$HO—(CH_2CH_2O)_a—(CH(CH_3)CH_2O)_b—(CH_2CH_2O)_c—H$$

wherein b is at least 15 and $(CH_2CH_2O)_{a+c}$ is varied from 20%–90% by weight.

Another type of surface active agent suitable for use in the composition of the present invention includes ethoxylated acetylenic alcohols and diols such as those available under the designations SURFYNOL® 465 and SURFYNOL® 485(W) from Air Products Co. A preferred surface active agent includes an acetylenic glycol decene diol.

Yet another type of surface active agent suitable for use in the present invention includes fluoropolymers and prepolymers such as, for example, fluorinated alkyl esters such as 2-N(alkyl perfluorooctane sulfonamido) ethyl acrylate which is available under designation FLUORAD FC-430 from 3M Co.

Yet another type of surface active agent suitable for use in the present invention includes epoxy silicones such as SILQUEST A-187 available from OSi Specialties, Inc., of Danbury, Conn., which has the formula:

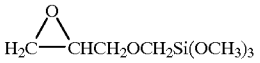

Generally, the surface active agent preferably constitutes from 0.1% to 20% of the total composition, more preferably 0.5% to 10%, and most preferably from 1% to 5%.

Polymerization of the energy-polymerizable composition of the present invention is preferably effected by the use of energy capable of inducing polymerization of the composition and of creating active sites in the textile, as discussed below. The energy can be derived from election beam (EB) radiation or, alternatively, ultra-violet (UV) radiation, infrared radiation (IR), or plasma. The preferred source of energy is EB radiation. Unlike UV radiation, EB radiation does not require the use of photoinitiators to induce polymerization.

The dosage of EB radiation should be sufficient to effect polymerization of the coating composition as well as activate the surface of the textile. Surface activation chemically alters the molecular structure of the textile to create chemically active sites to which the coating composition can bond. Thus, the coating composition becomes chemically grafted onto the textile when cured and is strongly adherent. Excess dosage of radiation can degrade the textile material. Therefore, the dosage of radiation should be sufficient to activate the textile surface and induce polymerization of the composition while being below that amount capable of causing noticeable damage to the textile. Determining such dosages for any particular composition and textile combination is within the knowledge and expertise of those with skill in the art. Typically, the total energy dose can range from about 5 to 22 Mrads, more preferably 7 to 20 Mrads and most preferably 13 to 19 Mrads.

When UV radiation is employed any photoinitiator suitable for the purposes described herein may be employed. Examples of useful photoinitiators include one or more compounds selected from benzildimethyl ketal, 2,2-diethoxy-1,2-diphenylethanone, 1-hydroxy-cyclohexyl-phenyl ketone, α,α-dimethoxy-α-hydroxy acetophenone, 1-(4-isopropylphenyl)-2-hydroxy-2-methyl-propan-1-one, 1-[4-(2-hydroxyethoxy)phenyl]-2-hydroxy-2-methyl-propan-1-one, 2-methyl-1-[4-(methylthio)phenyl]-2-morpholino-propan-1-one, 2-benzyl-2-dimethylamino-1-(4-morpholinophenyl)-butan-1-one, 3,6-bis(2-methyl-2-morpholino-propanonyl)-9 -butyl-carbazole, 4,4'-bis (dimethylamino)benzophenone, 2-chlorothioxanthone, 4-chlorothioxanthone, 2-isopropylthioxanthone, 4-isopropylthioxanthone, 2,4-dimethylthioxanthone, 2,4-diethylthioxanthone, 4-benzoyl-N,N-dimethyl-N-[2-(1-oxo-2-propenyl)oxy]ethylbenzenemethanaminium chloride, methyldiethanolamine, triethanolamine, ethyl 4-(dimethylamino)benzoate, 2-n-butoxyethyl 4-(dimethylamino)benzoate and combinations thereof.

Benzophenone, which is not per se a photoinitiator, may be used in photoinitiator compositions in conjunction with a coinitiator such as thioxanthone, 2-isopropyl thioxanthone, 4-isopropylthioxanthone, 2-chlorothioxanthone, 4-chlorothioxanthone, and amine coinitiators such as methyldiethanolamine and ethyl 4-(dimethylamino) benzoate.

It is preferable to have a blend of photoinitiators such that the combined absorption spectra of the individual photoinitiators matches the spectral output of the UV lamp (or other radiation emitter) used to effect the curing of the coating or ink composition. For example, mercury vapor lamps have strong emissions in the UV 2400 Å to 2800 Å range and in the UV 3400 Å to 3800 Å range. By choosing a suitable blend of photoinitiators a more efficient utilization of the spectral output of the lamp can be achieved. Such increased efficiency can translate to faster throughput during the radiation-polymerization process.

Moreover, inks and coatings employing the composition described herein can include colorants such as pigments and dyes which absorb UV light. For example, pigments generally absorb wavelengths of light below 3700 Å. To cure such a coating one needs to generate free radicals by using a photoinitiator which absorbs light above 3700 Å. A suitable photoinitiator for pigmented systems includes 2-benzyl-2-dimethylamino-1-(4-morpholinophenyl)-butan-1-one, which is commercially available under the designation Irgacure 369 from Ciba-Geigy.

To insure that the composition does not prematurely polymerize, a free radical inhibitor may optionally be added to the polymerizable composition. Examples of suitable inhibitors include hydroquinone and methyl ether thereof or butylated hydroxytoluene at a level of from 5 ppm to 2000 ppm by weight of the polymerizable components. Additives which are particularly useful in prolonging the shelf-life of the composition can also be used, e.g. UV stabilizers such as Fluorstab UV-II from Kromachem.

The UV radiation is preferably applied to a film of the present composition at an energy density of from 2,000 to 3,000 mJ/cm$^2$, more preferably 2,200 to 2,500 mJ/cm$^2$, in order to optimize through-curing of the film. While the film can be tack free with exposure to 20–40 mJ/cm$^2$, energy densities less than 2000 mJ/cm$^2$ produce a film with a lower degree of crosslinking (as measured by pendulum hardness testing), and energy densities greater than 3000 exhibit a deleterious effect on the cured film. Exposure times at the above-mentioned recommended energy density of no more than about 10 seconds, preferably no more than about 6 seconds, are sufficient to provide substantially complete polymerization and a tack-free cured composition.

When used as an ink composition can preferably include a colorant such as a pigment or dye. Various colorants suitable for use in the composition described herein are well known to those with skill in the art. Typical colorants include phthalocyanine blue, irgalite yellow, and the like.

An exemplary composition can be made containing the following components as set forth in Table I. The percentages are by weight based on total composition weight.

TABLE I

| | |
|---|---|
| Oligomer Component | From about 20% to about 63% of a composition containing an epoxy oligomer obtained by reacting a diglycidyl ether of bisphenol A with acrylic acid in the presence of Versamid 335 polyamide (10%) and propoxylated glycerol triacrylate (15%);<br>From about 10% to about 63% of a polyester acrylate oligomer such as trimethylol propane dimerester tetroacrylate or dipolyoxy-propylene glycerol adipate; |
| Monomer Component | At least one monomer selected from:<br>i. up to 49% trimethylol propane ethoxylate triacrylate, (available from Henkel Corporation under the designation Photomer 4158) and/or<br>ii. up to 47% neopentyl glycol propoxylate diacrylate (available from Henkel Corporation under the designation Photomer 4127) |
| Surface Active Agent Component | From 0% to 12% of ethylene oxide/propylene oxide block copolymer (available from BASF Corporation under the designation Pluronic F-108) |
| Colorant | From 0% to about 20% pigment |

The composition described herein may be employed as a screen printing ink in a conventional manner. A mask having at least one porous screen area configured in the shape of indicia (letters, graphics, and the like) is positioned in juxtaposition with a substrate. The screen can be a mesh fabricated from, for example, silk, polyester, polypropylene, high density polyethylene, nylon, glass, and metal such as nickel, aluminum, steel, etc. The textile substrate to which the ink is applied can be fabricated from cotton, silk, polyamide, polyester, polyolefin, or any other natural or synthetic fibers.

The ink is applied to the mask and at least some ink is forced through the porous screen area onto the textile substrate to create an image of the indicia on the substrate. The ink is then cured or hardened by exposing the ink to polymerizing energy such as EB radiation. Preferably, the inked substrate is passed under an energy source on a conveyor. The conveyor speed is adjusted to provide a sufficient exposure time. Such factors as the amount of pigment and its color may affect the exposure necessary to achieve a hard, tack-free coating. Generally, a single pass with a 6 second exposure time is sufficient to cure the present ink composition into a hard, tack free coating with an energy requirement of about 460 kJ/kg of fabric.

The mask may be fabricated by coating a screen with a radiation-polymerizable composition such as described herein. The composition can be applied to the screen by any conventional method such as spraying, dipping, brushing or rolling. The coating on the screen is then hardened by exposure to polymerizing radiation such as UV or EB to form a blank stencil. The blank stencil is then engraved by, for example, laser engraving, to form a mask containing porous areas in the shape of the desired indicia to be printed in the silk screen process.

Optionally, a textile substrate can be directly coated with the radiation-polymerizable composition described herein by spraying or dipping the textile fabric in the composition or by the use of brushes, rollers or other conventional coating methods. Compositions of the present invention can be used as surface modifying agents to improve the color fastness or water repellency of textiles, for example. The uncured composition remaining on the application equipment is readily washable with water.

The wettability of the composition described herein on a substrate such as nickel can be measured by contact angle goniometry. The present composition exhibits a contact angle on nickel of no more than 100°, more preferably no more than 70°, and most preferably no more than 30°.

The following examples are given for the purpose of illustrating the present invention.

EXAMPLE 1

An unpigmented composition was made containing the following components:

34 parts by weight of a composition containing an epoxy oligomer obtained by reacting a digycidyl ether of bisphenol A with acrylic acid in the presence of Versamid 335 polyamide (10%) and propoxylated glycerol triacrylate 34 parts by weight of polyester acrylate 2 parts by weight of trimethylol propane ethoxylate triacrylate (Photomer 4158)

14 parts by weight of neopentyl glycol propoxylate diacrylate (Photomer 4127)

6 parts by weight of ethylene oxide/propylene oxide block copolymer surface active agent (Pluronic F-108)

EXAMPLE 2

A pigmented composition was made containing the following components:

34 parts by weight of a composition containing an epoxy oligomer obtained by reacting a digycidyl ether of bisphenol A with acrylic acid in the presence of Versamid 335 polyamide (10%) and propoxylated glycerol triacrylate.

34 parts by weight of polyester acrylate 2 parts by weight of Photomer 4158

14 parts by weight of Photomer 4127

10 parts by weight of pigment 6 parts by weight of Pluronic F-108

EXAMPLE 3

The unpigmented composition of Example 1 was coated onto several samples of aluminum substrate and polymerized by election beam radiation at various dosages under the following conditions:

beam intensity: 3m A beam voltage: 165 kV cathode power: 165 kV

Avg. $O_2$ level: 18 ppm

The cured films formed on the aluminum substrate samples were then tested for hardness by the Konig pendulum hardness (KPH) test. The following results were obtained:

| Sample | Dose (Mrads) | Hardness (KPH Counts) |
|---|---|---|
| 1 | 7.3 | 130.33 |
| 2 | 9.8 | 146.11 |
| 3 | 13.4 | 154.22 |
| 4 | 16.5 | 149.11 |
| 5 | 18.4 | 148.75 |
| 6 | 21.9 | 147.06 |

These results show that the greatest hardness for the unpigmented composition was obtained with a dosage of about 13.4 Mrads, which represents the optimum exposure.

EXAMPLE 4

The pigmented composition of Example 2 was coated onto several aluminum substrates and polymerized by electron beam radiation under the conditions and dosages set forth in Example 3. The samples were tested for hardness to determine the maximum hardness as determined by the Konig pendulum hardness test. The optimum dosage was found to be 18.4 Mrad.

EXAMPLE 5

The grafting efficiency of the energy curable composition of Example 1 was tested as follows:

A cured film obtained by electron beam irradiation of the composition of Example 1 on an aluminum substrate at optimum dosage was extracted with methanol at 70° C. About 2.8% extractables were obtained.

A non-irradiated and uncoated textile fabric sample was extracted with methanol at 70° C. About 0.93% extractables were obtained.

An electron beam irradiated uncoated textile fabric was extracted with methanol at 70° C. About 0.84% extractables were obtained.

Several textile sample were coated with the composition of Example 1 and irradiated with electron beam radiation at dosages of from about 7.3 Mrad to about 21.9 Mrad. The textile samples were extracted with methanol at 70° C. About 0.78% to about 0.97% extractables were obtained, the higher percentage of extractables corresponding to the higher energy dosages.

These data show electron beam radiation of an uncoated textile fabric produces a surface modification which reduces extractables. The lower percentage of extractables from the coated textile as compared with the coated aluminum substrate shows that grafting of the composition onto the textile is achieved. The grafting efficiency exceeds 99%.

While the above description contains many specifics, these specifics should not be construed as limitations on the scope of the invention, but merely as exemplifications of preferred embodiments thereof. Those skilled in the art will envision many other possible variations that are within the scope and spirit of the invention as defined by the claims appended hereto.

What is claimed is:

1. A method for coating a textile, comprising the steps:

a) providing a substantially water-free, energy-curable, polymer-forming composition containing i. an epoxy acrylate oligomer having at least two ethylenically unsaturated moieties, and ii. at least one alkoxylated polyol monomer having at least two ethylenically unsaturated moieties and capable of being polymerized with epoxy acrylate oligomer (i) to provide a solid cured polymer when exposed to energy polymerizing conditions, and said solid cured polymer being capable of chemically bonding to active sites on the textile;

b) applying said polymer-forming composition to the textile; and c) exposing the textile to a source of energy under such conditions as to generate active sites on the textile, curing the polymer-forming composition to provide a polymer, and forming chemical bonds between the textile and the cured polymer.

2. The method of claim 1 wherein the polymer-forming composition includes a colorant.

3. The method of claim 2 wherein the step of applying the polymer-forming composition to the textile comprises the steps of:

a) providing a mask having at least one porous screen area configured in the shape of indicia;

b) positioning the mask in juxtaposition with the textile; and c) applying the polymer-forming composition to the mask and moving at least a portion of the composition through the porous screen area onto the textile to form inked areas of the textile configured in the shape of indicia.

4. The method of claim 3 wherein the step of providing a mask includes the steps of:

a) providing a porous screen;

b) coating the screen with an energy-curable screen coating composition;

c) curing the screen coating composition by exposing the screen to energy-curing conditions to form a blank stencil; and d) engraving indicia in said blank stencil to form the mask.

5. The method of claim 4 wherein said engraving step is performed by means of a laser.

6. The method of claim 1 wherein the energy is derived from electron beam radiation.

7. The method of claim 6 wherein the electron beam radiation is at a dosage ranging from about 7 to 20 Mrads.

8. The method of claim 6 wherein the electron beam radiation is at a dosage ranging from about 13 to about 19 Mrad.

9. The method of claim 1 wherein the acrylate oligomer is thixotropic.

10. The method of claim 1 wherein the energy is derived from ultraviolet radiation and the polymer-forming composition further includes a photoinitiator.

11. The method of claim 10 wherein the photoinitiator is at least one member selected from the group consisting of benzildimethyl ketal, 2,2-diethoxy-1,2-diphenylethanone, 1-hydroxy-cyclohexyl-phenyl ketone, α,α-dimethoxy-α-hydroxy acetophenone, 1-(4-isopropylphenyl)-2-hydroxy-2-methyl-propan-1-one, 1-[4-(2-hydroxyethoxy)phenyl]-2-hydroxy-2-methyl-propan-1-one, 2-methyl-1-[4-(methylthio)phenyl]-2-morpholino-propan-1-one, 2-benzyl-2-dimethylamino-1-(4-morpholinophenyl)-butan-1-one, 3,6-bis(2-methyl-2-morpholino-propanonyl)-9-butylcarbazole, 4,4'-bis(dimethylamino)benzophenone, 2-chlorothioxanthone, 4-chlorothioxanthone, 2-isopropylthioxanthone, 4-isopropylthioxanthone, 2,4-dimethylthioxanthone, 2,4-diethylthioxanthone, 4-benzoyl-N,N-dimethyl-N-[2-(1-oxo-2-propenyl)oxy]ethylbenzenemethanaminium chloride, methyldiethanolamine, triethanolamine, ethyl 4-(dimethylamino)benzoate, 2-n-butoxyethyl 4-(dimethylamino)benzoate and combinations thereof.

12. The method of claim 1 wherein the step of applying the polymer-forming composition to the textile comprises a method selected from the group consisting of dipping, brushing, spraying and rolling.

13. The method of claim 1 wherein the textile is fabricated from a fibrous material selected from the group consisting of cotton, silk, polyester, polyamide, polyolefin, and combinations thereof.

14. The method of claim 1 wherein the acrylate oligomer is selected from the group consisting of epoxy acrylate oligomer, polyurethane acrylate oligomer and polyester acrylate oligomer.

15. The method of claim 14 wherein the epoxy acrylate oligomer is derived from a compound having the formula:

$$R^1—[—CH_2—CHOH—CH_2—O(O)C—CH=CH_2]_n$$

wherein $R^1$ is an aliphatic, aromatic or arene moiety having at least two carbon atoms and at least two oxido residues, and n is an integer of from 2 to about 6.

16. The method of claim 15 wherein $R^1$ is a bisphenol residue.

17. The method of claim 15 wherein $R^1$ is selected from the group consisting of hydroquinone residue and catechol residue.

18. The method of claim 15 wherein $R^1$ includes a straight or branched chain alkyl group of from 2 to about 6 carbon atoms.

19. The method of claim 18 wherein $R^1$ is selected from the group consisting of ethylene glycol residue, propylene glycol residue, trimethylolpropane residue, pentaerythritol residue, neopentyl glycol residue, glyceryl residue, diglyceryl residue, inositol residue, and sorbitol residue.

20. The method of claim 15 wherein $R^1$ is a saturated or unsaturated, straight or branched chain aliphatic moiety of from about 6 to about 24 carbon atoms.

21. The method of claim 20 wherein $R^1$ is an epoxidized soy bean oil residue.

22. The method of claim 20 wherein $R^1$ is a polyethylene glycol moiety.

23. The method of claim 20 wherein $R^1$ is an ethylene oxide-propylene oxide copolymer.

24. The method of claim 14 wherein the epoxy acrylate oligomer is obtained by reacting a diepoxide with an acid component having an ethylenically unsaturated carboxylic acid or reactive derivative thereof in the presence of a polyamide derived from a polymerized fatty acid.

25. The method of claim 24 wherein the acid component is acrylic acid.

26. The method of claim 25 wherein the diepoxide is a diglycidyl ether of a dihydric phenol.

27. The method of claim 14 wherein the polymer-forming composition includes from about 10% to about 25% of the at least one alkoxylated polyol diacrylate and from about 10% to about 25% by weight of the at least one alkoxylated polyol triacrylate based on total composition weight.

28. The method of claim 1 wherein the alkoxylated polyol monomer has the formula:

$$R^2—[—(Y)_x—R^3—CH=CH—R^4]_n$$

wherein $R^1$ is an aliphatic, aromatic, or arene moiety having at least two carbon atoms and at least two oxido residues, Y is an alkylene oxide moiety and x is an integer of from 2 to about 6, $R^3$ is a linkage group capable of joining the alkylene oxide moiety Y and the —CH=CH— group, $R^4$ is hydrogen or $—C(O)OR^5$ wherein $R^5$ is hydrogen or an alkyl group having from 1 to about 22 carbon atoms, and n is an integer of from 2 to about 6.

29. The method of claim 28 wherein $R^2$ is a bisphenol residue.

30. The method of claim 28 wherein $R^2$ is selected from the group consisting of hydroquinone residue and catechol residue.

31. The method of claim 28 wherein $R^2$ includes a straight or branched chain alkyl group of from 2 to about 6 carbon atoms.

32. The method of claim 28 wherein $R^2$ is selected from the group consisting of ethylene glycol residue, propylene glycol residue, trimethylolpropane residue, pentaerythritol residue, neopentyl glycol residue, glyceryl residue, diglyceryl residue, inositol residue, and sorbitol residue.

33. The method of claim 28 wherein $R^2$ is a saturated or unsaturated, straight or branched chain aliphatic moiety of from about 6 to about 24 carbon atoms.

34. The method of claim 28 wherein $R^2$ is an epoxidized soy bean oil residue.

35. The method of claim 28 wherein $R^2$ is a polyethylene glycol moiety.

36. The method of claim 28 wherein $R^2$ is an ethylene oxide-propylene oxide copolymer.

37. The method of claim 28 wherein Y is an ethylene oxide residue.

38. The method of claim 28 wherein $R^3$ is a member selected from the group consisting of —O—, —O(O)C—, $—OCH_2CH_2—$ and $—OCH_2CHOHCH_2O(O)C—$.

39. The method of claim 28 wherein the at least one alkoxylated polyol monomer comprises a mixture of at least one alkoxylated polyol diacrylate and at least one alkoxylated polyol triacrylate.

40. The method of claim 39 wherein the polymer-forming composition exhibits a contact angle on nickel of no more than about 100°.

41. The method of claim 39 wherein the polymer-forming composition exhibits a contact angle on nickel of no more than about 70°.

42. The method of claim 39 wherein the polymer-forming composition exhibits a contact angle on nickel of no more than about 30°.

43. The method of claim 39 wherein the polymer-forming composition includes from about 5% to about 30% of the at least one alkoxylated polyol diacrylate and from about 5% to about 30% of the at least one alkoxylated polyol triacrylate based on total composition weight.

44. The method of claim 39 wherein the polymer-forming composition includes from about 15% to about 20% of the at least one alkoxylated polyol diacrylate and from about 15% to 20% of the at least one alkoxylated triacrylate based on total composition weight.

45. The method of claim 39 wherein the at least one alkoxylated polyol triacrylate is trimethylolpropane ethoxylate triacrylate and the at least one alkoxylated polyol diacrylate is a member selected from the group consisting of bisphenol A ethoxylate diacrylate, neopentyl glycol propoxylate diacrylate and mixtures thereof.

46. The method of claim 45 wherein the acrylate oligomer is derived from bisphenol A epoxy diacrylate.

47. The method of claim 45 wherein the monomer mixture includes from about 10% to about 15% by weight of neopentyl glycol propoxylate diacrylate, and from about 15% to about 20% by weight of trimethylolpropane ethoxylate triacrylate, based on total composition weight.

48. The method of claim 47 wherein the monomer mixture further includes from about 5% to about 10% bisphenol A ethoxylate diacrylate.

49. The method of claim 47 wherein the acrylate oligomer is obtained by reacting a diepoxide with acrylic in the presence of a polyamide derived from a polymerized fatty acid.

50. The method of claim 49 wherein the diepoxide is a diglycidyl ether of a dihydric phenol.

51. A textile coated in accordance with the method of claim 1.

52. The textile of claim 51 wherein said textile is a cotton fabric.

53. A method for coating a textile comprising the steps:

a) providing a substantially water-free, energy-curable, polymer-forming composition containing
   i. an epoxy acrylate oligomer having at least two ethylenically unsaturated moieties,
   ii. at least one alkoxylated polyol monomer having at least two ethylenically unsaturated moieties and capable of being polymerized with epoxy acrylate oligomer (i) to provide a solid cured polymer when exposed to energy polymerizing conditions, and said solid cured polymer being capable of chemically bonding to active sites on the textile, and
   iii. a surface active agent capable of being integrated by covalent bonding or hydrogen bonding into the molecular structure of the polymer;

b) applying said polymer-forming composition to the textile; and c) exposing the textile to a source of energy under such conditions as to generate active sites on the textile, curing the polymer-forming composition to provide a polymer, and forming chemical bonds between the textile and the cured polymer.

54. The method of claim 53 wherein the surface active agent includes a block copolymer of ethylene oxide/propylene oxide.

55. The method of claim 53 wherein the surface active agent possesses at least one unsaturated site, the surface active agent being integrated into the molecular structure of the polymer by covalent bonding.

56. The method of claim 55 wherein the surface active agent includes a compound having at least one acetylenic bond.

57. The method of claim 53 wherein the surface active agent includes an acetylenic glycol decene diol.

58. The method of claim 53 wherein the surface active agent includes a fluorinated alkyl ester.

59. The method of claim 53 wherein the surface active agent includes 2-N(alkyl perfluoro octane sulfonamido)ethyl acrylate.

60. The method of claim 53 wherein the surface active agent includes an epoxy silicone.

61. The method of claim 60 wherein the epoxy silicone includes a compound having the formula:

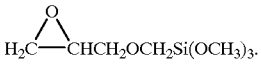

62. A composition for coating textiles comprising:

a) an epoxy oligomer obtained by reacting a diepoxide with acrylic acid in the presence of a polyamide derived from a polymerized fatty acid;

b) a monomer mixture which includes at least one compound selected from the group consisting of trimethylol propane ethoxylate triacrylate, trimethylol propane ethoxylate diacrylate, neopentyl glycol propoxylate diacrylate and bisphenol A ethoxylate diacrylate; and c) a surface active agent capable of being integrated by covalent bonding or hydrogen bonding into the molecular structure of a polymer formed by curing the epoxy oligomer and monomer mixture.

63. The composition of claim 62 further including a colorant.

* * * * *